US009157162B2

(12) United States Patent
Shih

(10) Patent No.: US 9,157,162 B2
(45) Date of Patent: Oct. 13, 2015

(54) METHOD OF FORMING TOOL MARKING STRUCTURE

(71) Applicant: Leo Shih, Taichung (TW)

(72) Inventor: Leo Shih, Taichung (TW)

( * ) Notice: Subject to any disclaimer, the term of this patent is extended or adjusted under 35 U.S.C. 154(b) by 205 days.

(21) Appl. No.: 13/714,305

(22) Filed: Dec. 13, 2012

(65) Prior Publication Data

US 2014/0120261 A1 May 1, 2014

(30) Foreign Application Priority Data

Oct. 26, 2012 (TW) ..... 101139702 A

(51) Int. Cl.

| | |
|---|---|
| ***B05D 1/36*** | (2006.01) |
| ***C25D 7/00*** | (2006.01) |
| ***C25D 5/02*** | (2006.01) |
| *B05D 5/06* | (2006.01) |
| *C25D 13/12* | (2006.01) |

(52) U.S. Cl.
CPC *C25D 7/00* (2013.01); *C25D 5/022* (2013.01); *B05D 5/06* (2013.01); *C25D 13/12* (2013.01)

(58) Field of Classification Search
CPC ..... B05D 1/36; B05D 5/06; B25B 13/00; C25D 5/00
USPC ..... 427/256
See application file for complete search history.

(56) References Cited

U.S. PATENT DOCUMENTS

2009/0288522 A1* 11/2009 Tseng ..... 81/121.1
2010/0180659 A1* 7/2010 Lin ..... 72/367.1

* cited by examiner

*Primary Examiner* — Xiao Zhao
(74) *Attorney, Agent, or Firm* — Raymond Y. Chan; David and Raymond Patent Firm

(57) ABSTRACT

A method of forming a tool marking structure includes: a coloring step of coloring a predetermined position of the first protective layer so as to form a marking area with a color layer and forming the first protective layer on a bottom surface of the marking area, and a second-time surface processing step of forming a second protective layer on a non-marking area of the tool and forming the first protective layer on a bottom surface of the second protective layer; wherein the color of the first protective layer is different from that of the second protective layer.

10 Claims, 9 Drawing Sheets

METHOD OF FORMING TOOL MARKING STRUCTURE

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention relates to a method of forming a tool marking structure which is capable of clearly distinguishing the size of a tool and obtaining an anti-rust function even though the color layer of the marking area of the tool is rubbed.

2. Description of Related Arts

As shown in FIG. 1, a conventional method of forming a tool marking structure which comprises: electroplating a tool 10 so as to form a plating layer 11 on the tool 10, and printing colorful patterns 12 on a surface of the tool 10. However, when the colorful patterns 12 are rubbed after a long period of use, the color of the plating layer 11 is revealed, therefore the colorful patterns 12 can no longer be viewed and distinguished.

Referring further to FIG. 2, another conventional method of forming a tool marking structure which comprises: imprinting a tool 20 so that concave patterns 21 are formed on the tool 20, and printing a color layer on the concave patterns 21; thereafter electroplating the tool 20 so that the surface of the tool 20 outside the concave patterns 21 has a plating layer 22. In the plating process, a plating layer cannot be formed on a bottom surface or on the surface of the color layer, so when the color layer is rubbed, the concave patterns 21 rust badly.

With reference to FIG. 3, another conventional method of forming a tool marking structure which comprises: electroplating a tool 30 so as to form a plating layer 31 on the tool 30, imprinting concave patterns 32 at a predetermined position of the tool 30; thereafter printing a color layer on the concave patterns 32. Although the color layer of the concave patterns 32 is rubbed after a long period of use, the concave patterns 32 are revealed and have the plating layer 31 formed on a bottom surface thereof. The colors of the plating layers 31 of the concave patterns 32 and the tool 30 are the same, so the concave patterns 32 cannot be clearly distinguished.

The present invention has arisen to mitigate and/or obviate the afore-described disadvantages.

SUMMARY OF THE PRESENT INVENTION

The main object of the present invention is to provide a method of forming a tool marking structure which is capable of distinguishing the size of a tool clearly and obtaining an anti-rust function even though the color layer of the marking area of the tool is rubbed.

To obtain the above objective, a method of forming a tool marking structure provided by a first embodiment of the present invention comprises:

a first-time surface processing step including forming a first protective layer on a tool;

a coloring step including coloring a predetermined position of the first protective layer so as to form a marking area with a color layer, and forming the first protective layer on a bottom surface of the marking area;

a second-time surface processing step including forming a second protective layer on a non-marking area of the tool, and forming the first protective layer on a bottom surface of the second protective layer, wherein the color of the first protective layer is different from that of the second protective layer.

In addition, a method of forming a tool marking structure provided by a second embodiment of the present invention contains:

a first-time surface processing step including forming a first protective layer on a tool;

a coloring step including coloring a predetermined position of the first protective layer so as to form a marking area with a color layer, wherein the marking area has a first color area and a second color area, and the color of the first color area is different from that of the second color area, additionally a spacing area without any color layer is defined between the first color area and the second color area, and two bottom surfaces of the color first area and the second color area have the first protective layer;

a second-time surface processing step including forming a second protective layer in a non-marking area of the tool and the spacing area, and forming the first protective layer on a bottom surface of the second protective layer, wherein the color of the first protective layer is different from that of the second protective layer.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
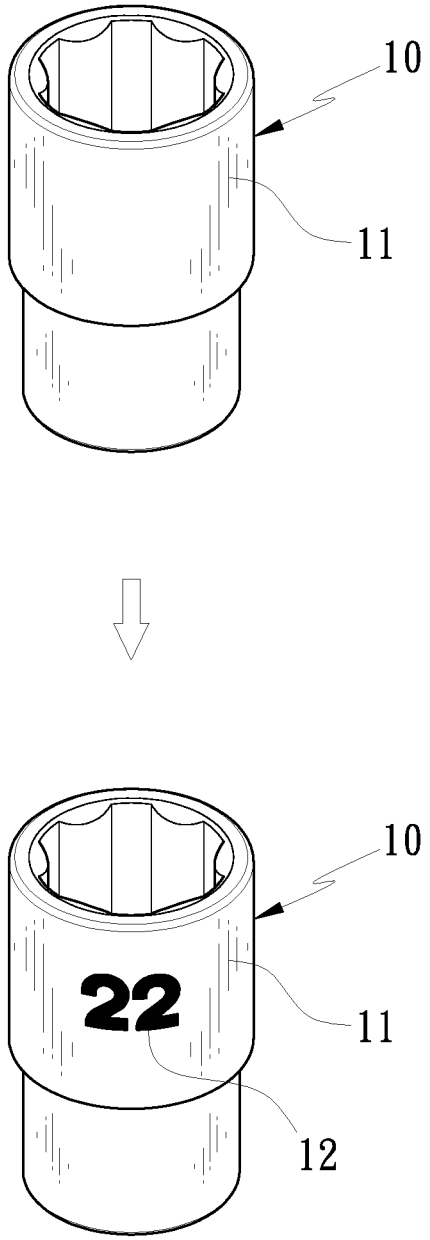
F I G . 1 PRIOR ART
FIG. 1 is a perspective view of a conventional method of forming a first tool marking structure.
Figure 2:
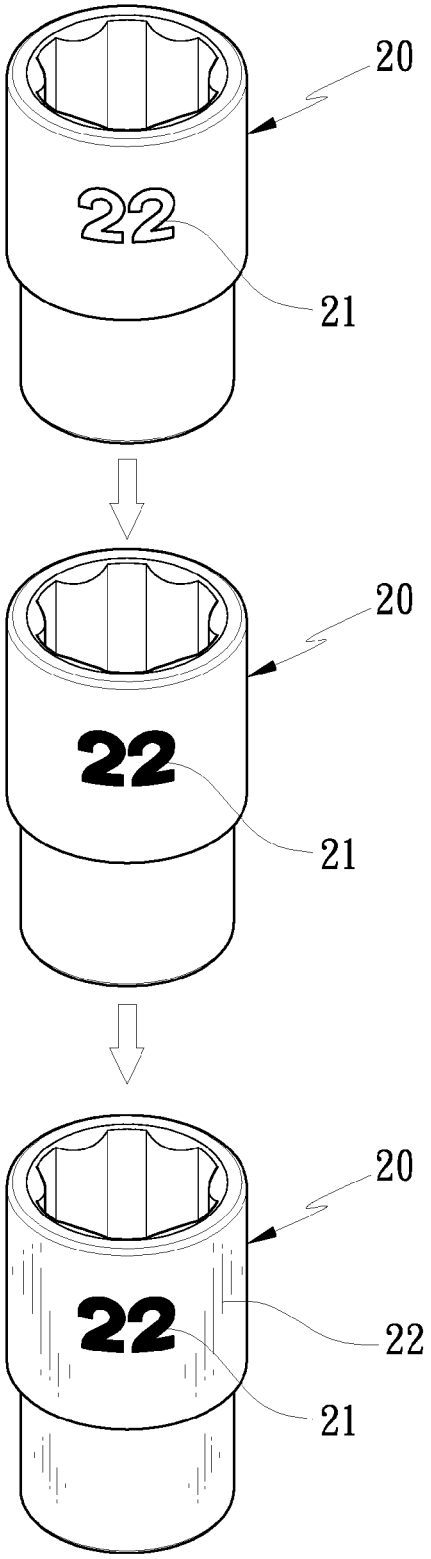
F I G . 2 PRIOR ART
FIG. 2 is a perspective view of a conventional method of forming a second tool marking structure.
Figure 3:
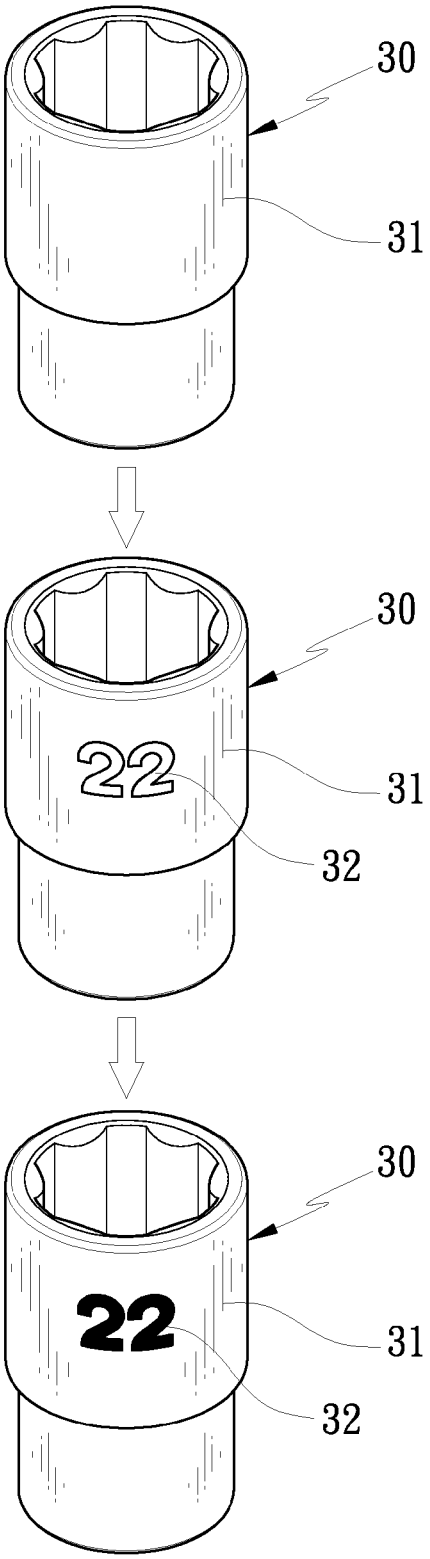
F I G . 3 PRIOR ART
FIG. 3 is a perspective view of a conventional method of forming a third tool marking structure.
Figure 4:
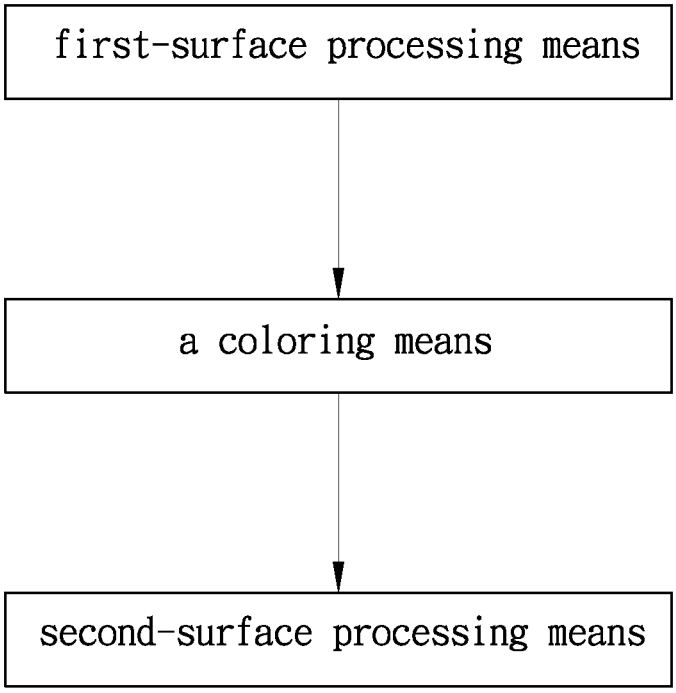
FIG. 4 is a flow chart of a method of forming a tool marking structure according to a first embodiment of the present invention.
Figure 5:
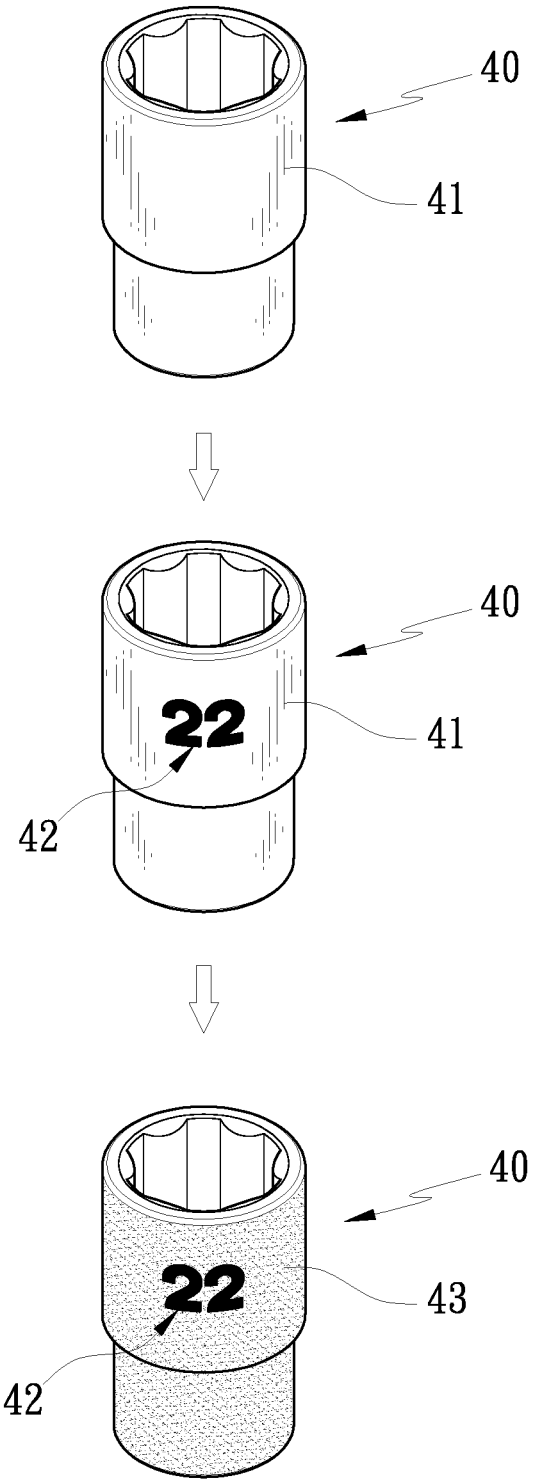
FIG. 5 is a perspective view showing a tool marking structure according to the first embodiment of the present invention.

With reference to FIGS. 4 and 5, a method of forming a tool marking structure, such as a sleeve tool, according to a first embodiment of the present invention which comprises: a first-time surface processing step including forming a first protective layer 41 on a tool 40, wherein the first-time surface processing step is an electroplating means, an electrodeposition means, an air dyeing means, or a blackening means. In this embodiment, the first-time surface processing step is an electroplating means. For example, electroplating the tool 40 so as to form the first protective layer 41 which then a coloring step including coloring a predetermined position of the first protective layer 41 so as to form a marking area 42 with a color layer is performed. The coloring step is a printing means or an affixing means. In this embodiment, the coloring step includes printing the marking area 42 and forming the first protective layer 41 on a bottom surface of the marking area 42, and then forming a second protective layer 43 on a non-marking area of the tool 40, wherein a color of the second protective layer 43 is different from that of the first protective layer 41. The second-time surface processing step is an electroplating means, an electrodeposition means, or a blackening means. In this embodiment, the second-time surface processing step is an electroplating means, because it is an electroplating means the marking area 42 does not cause a plating reaction. The plating reaction only occurs in the non-marking area; the non-marking area of the tool 40 is electroplated to form the second protective layer 43. In addition, due to the electroplating means; copper plating, chrome plating, or nickel plating may be utilized, wherein different platings will produce a plurality of protective layers with different colors. Accordingly, while applying a plating in the second-time surface processing step different from the first-surface processing step, the color of the second protective layer 43 is different from that of the first protective layer 41. Also, a color of the second protective layer 43 is different from that of the color layer of the marking area 42 so that a color contrast is produced between the marking area 42 and the second protective layer 43 of the non-marking area of the tool 40, thus obtaining obvious identification effect.

Figure 6:
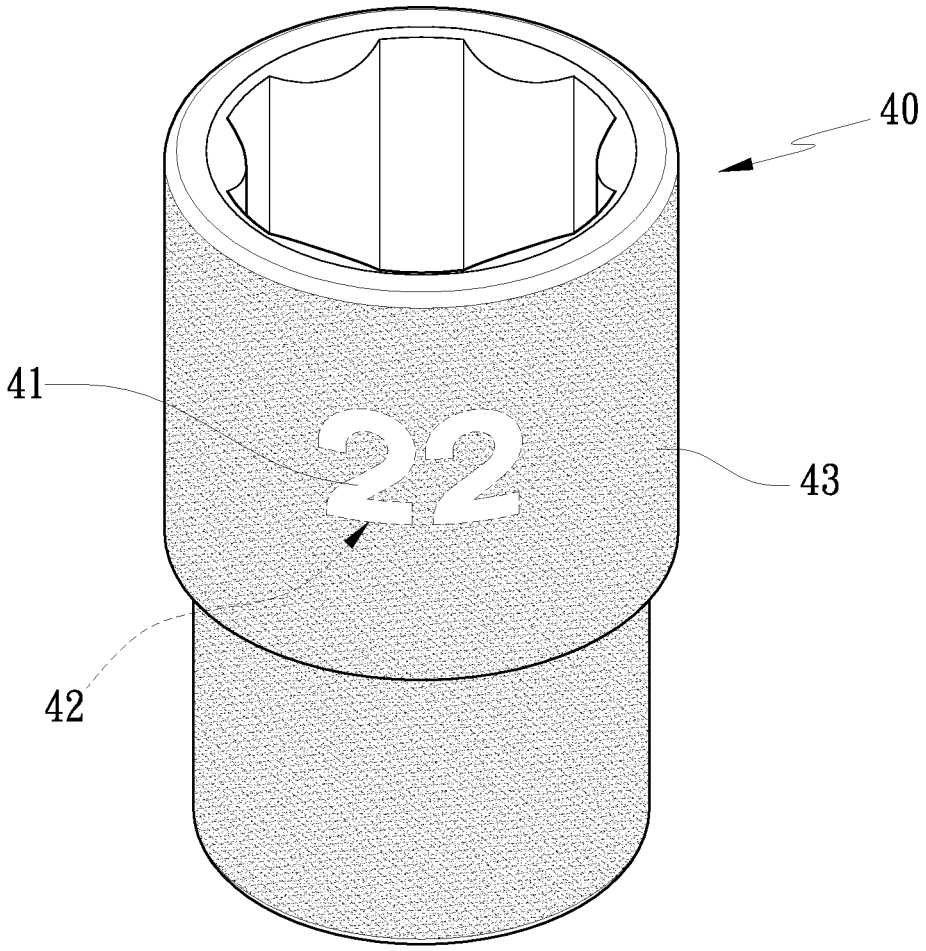
FIG. 6 is a perspective view showing the tool marking structure is used after a long period of using time according to the first embodiment of the present invention.

Referring further to FIG. 6, when the color layer of the marking area 42 is rubbed after a long period of use, the bottom surface of the color layer of the marking area 42 has the first protective layer 41 electroplated thereon, so the tool 40 still has rustproof effect by ways of the first protective layer 41. Likewise, because the color of the first protective layer 41 is different from that of the second protective layer 43, the user identifies the tool 40 by using the color contrast between the first protective layer 41 and the second protective layer 43.

Figure 7:
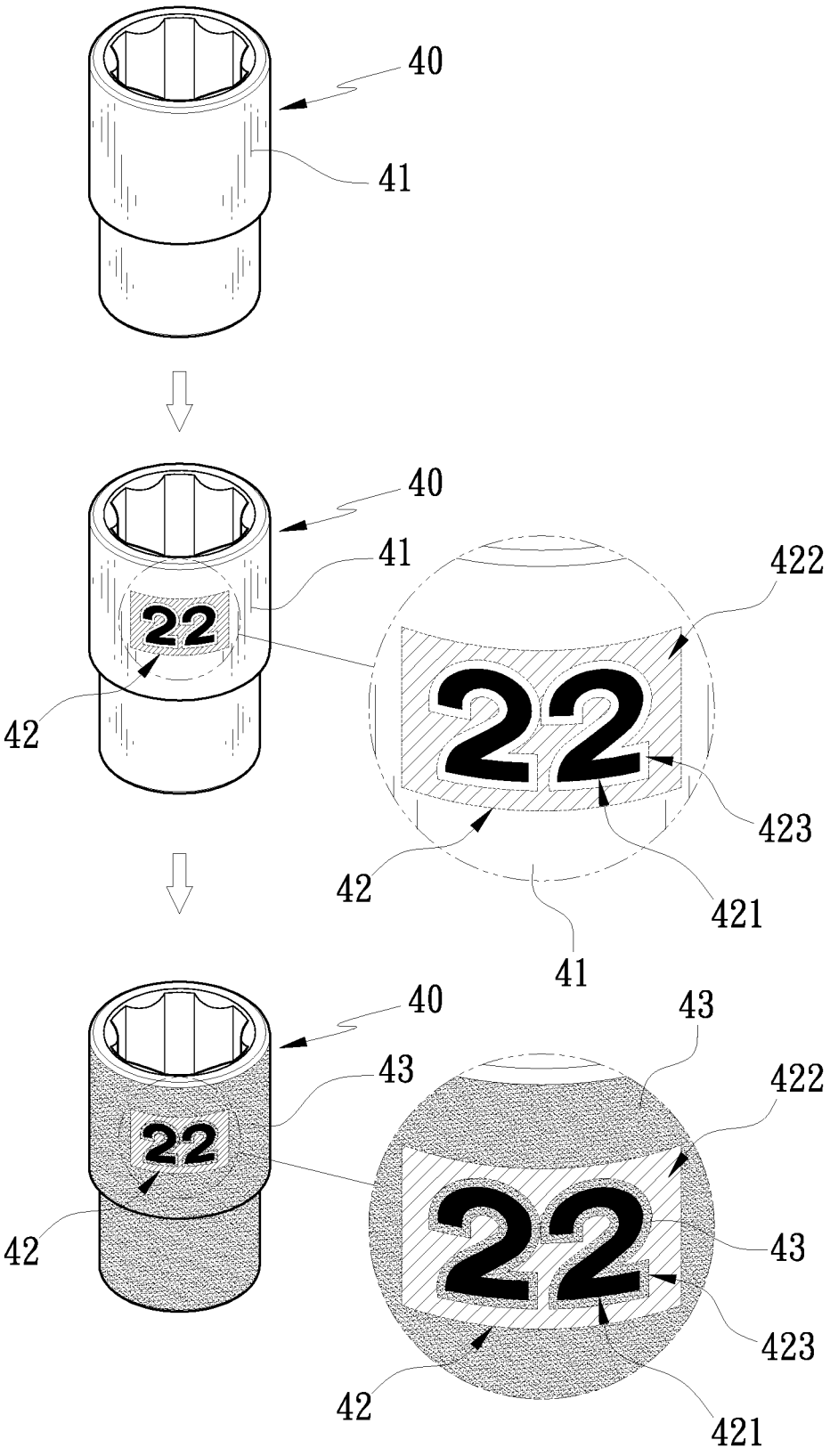
FIG. 7 is a perspective view showing a tool marking structure according to a second embodiment of the present invention.

Referring further to FIGS. 4 and 7, a method of forming a tool marking structure, such as a sleeve tool, according to a second embodiment of the present invention which comprises: a first-time surface processing step including forming a first protective layer 41 on a tool 40, wherein the first-time surface processing step is an electroplating means, an electrodeposition means, an air dyeing means, or a blackening means. In this embodiment, the first-time surface processing step is the electroplating means. For example, electroplating the tool 40 so as to form the first protective layer 41, which then a coloring step including coloring a predetermined position of the first protective layer 41 so as to form a marking area 42 with a color layer is performed. The coloring step is a printing means or an affixing means. In this embodiment, the coloring step includes printing the marking area 42 and forming the first protective layer 41 on a bottom surface of the marking area 42, wherein the marking area 42 has a first color area 421 and a second color area 422, and a color of the first color area 421 is different from that of the second color area 422. Additionally a spacing area 423 without any color layer is defined between the first color area 421 and the second color area 422. In the second-time surface processing step, a second protective layer 43 is formed in a non-marking area of the tool 40 and the spacing area 423, wherein a color of the second protective layer 43 is different from that of the first protective layer 41. The second-time surface processing step is an electroplating means, an electrodeposition means, or a blackening means. In this embodiment, the second-time surface processing step is an electroplating means, and because in an electroplating step, the first color area 421 and the second color area 422 of the marking area 42 do not cause a plating reaction, but the plating reaction only occurs in the non-marking area and the spacing area 423. The non-marking area and the spacing area 423 of the tool 40 are electroplated to form the second protective layer 43. In addition, due to the electroplating means; copper plating, chrome plating, or nickel plating may be utilized, wherein different platings will produce a plurality of protective layers with different colors. Accordingly, while applying plating in the second-time surface processing step different from the first-time surface processing step, the color of the second protective layer 43 is different from that of the first protective layer 41. Also, the color of the second protective layer 43 is different from those of the first color area 421 and the second color area 422 of the marking area 42 so that three color contrasts produce among the first color area 421 of the marking area 42, the second color area 422 of the marking area 42, and the second protective layer 43 of the non-marking area and the spacing area 423, thus obtaining obvious identification effect.

Figure 8:
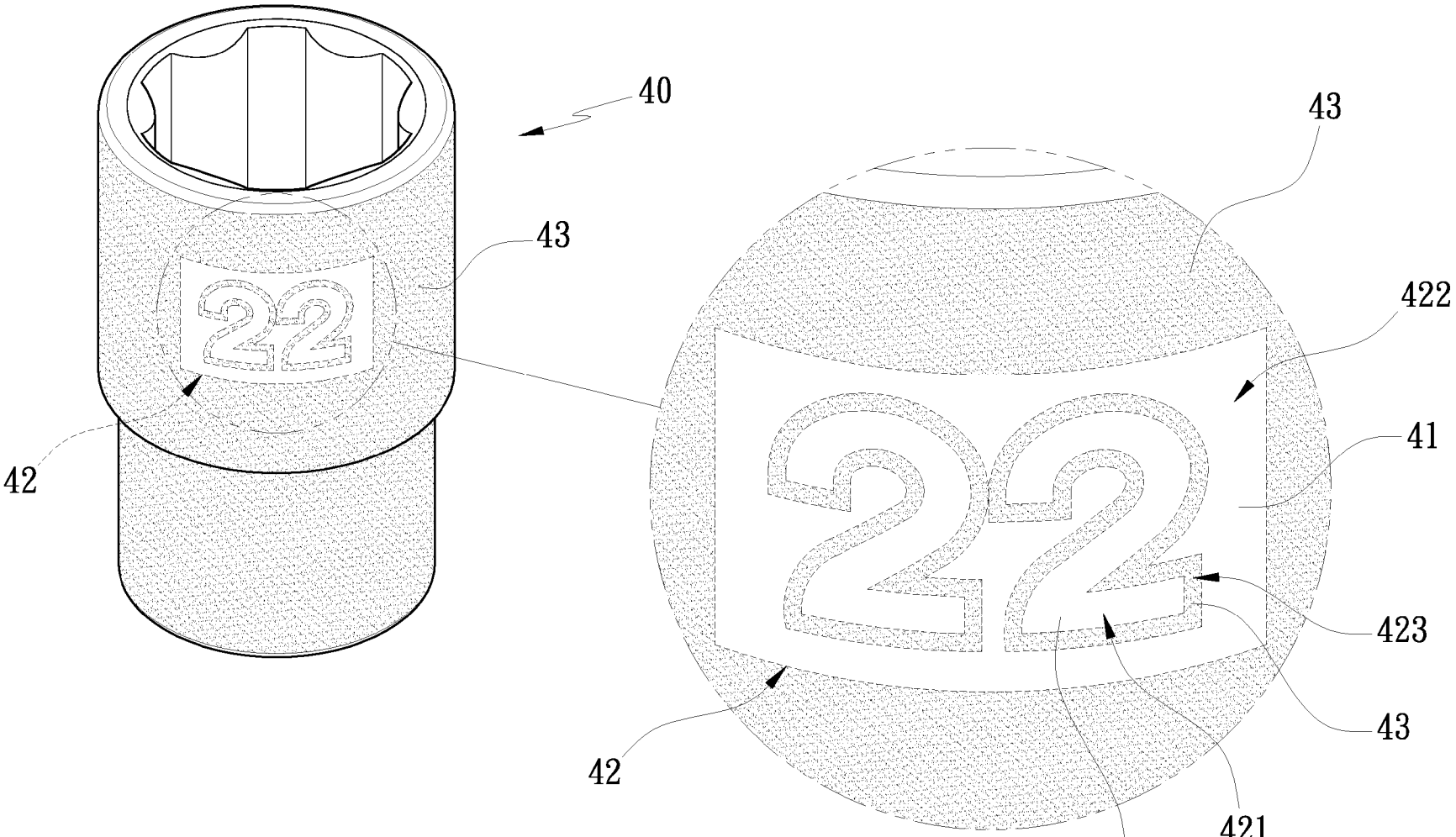
FIG. 8 is a perspective view showing the tool marking structure is used after a long period of using time according to the second embodiment of the present invention.

Referring further to FIG. 8, when colors of the first color area 421 and the second color area 422 of the marking area 42 are rubbed after a long period of use, the two bottom surfaces of the color first area 421 and the second color area 422 will have the first protective layer 41 electroplated thereon, so the tool 40 still has an rustproof effect by ways of the first protective layer 41. Likewise, after the colors of the first color area 421 and the second color area 422 of the marking area 42 are rubbed, the color of the first protective layer 41 is visible to the user, and the color of the spacing area 423 is identical to that of the second protective layer 43. Since the color of the first protective layer 41 is different from that of the second protective layer 43, the user identifies the tool 40 by using the color contrast between the first protective layer 41 and the second protective layer 43.

Figure 9:
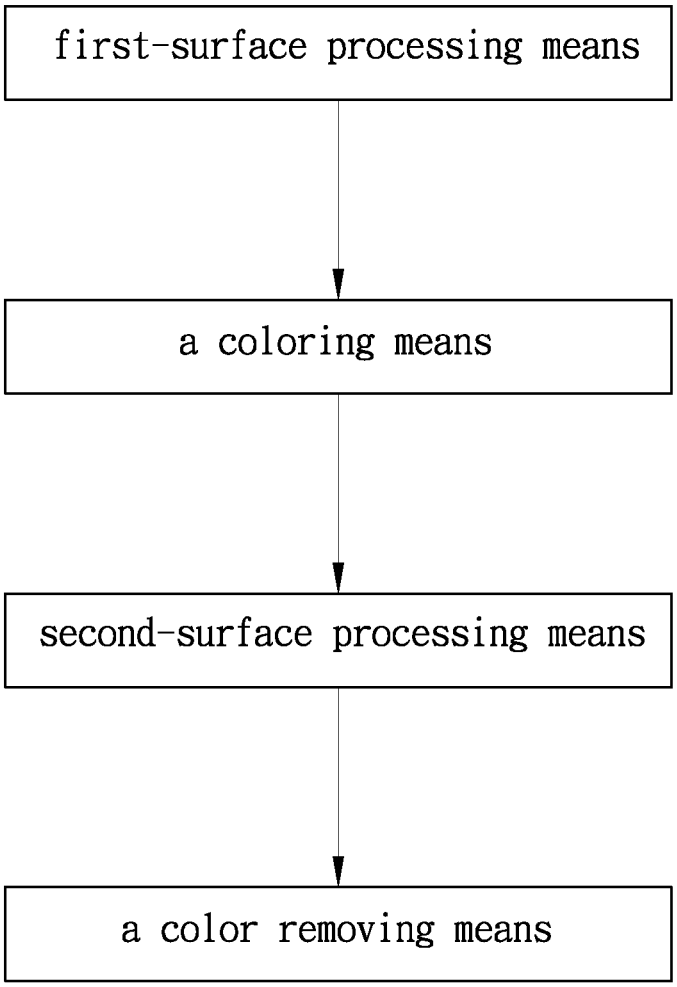
FIG. 9 is a flow chart of a method of forming a tool marking structure according to a third embodiment of the present invention.

As shown in FIG. 9, a method of forming a tool marking structure according to a third embodiment of the present invention is used to prevent any color layer from being rubbed. After the first-time surface processing step, the coloring step, and the second-time surface processing step, a color removing step is executed so as to remove the color layer of the marking area. As illustrated in FIG. 6, after the color layer of the marking structure 42 is removed in the color removing step, the first protective layer 41 is electroplated on a bottom surface of the color layer of the marking area 42, so even through the color layer of the marking area 42 is removed, the tool 40 still has rustproof effect by ways of the first protective layer 41. Likewise, because the color of the first protective layer 41 appears after removing the color layer of the marking area 42, and the color of the first protective layer 41 is different from that of the second protective layer 43 of the non-marking area, the user identifies the tool 40 by using the color contrast between the first protective layer 41 and the second protective layer 43. Referring further to FIG. 8, after the color layer of the marking area 42 is removed in the color removing step, because the two bottom surfaces of the color first area 421 and the second color area 422 have the first protective layer 41 electroplated thereon, so that the tool 40 still has rustproof effect by ways of the first protective layer 41, after the color layer of the first color area 421 and the second color area 422 of the marking area 42 is removed.

Likewise, after the color layer of the first color area 421 and the second color area 422 of the marking area 42 is removed, the color of the first protective layer 41 appears. Also, because the color of the first protective layer 41 is different from that of the second protective layer 43 of the non-marking area and the spacing area 423, the user identifies the tool 40 by using a color contrast between the first protective layer 41 and the second protective layer 43.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A method of marking a tool structure, comprising:

a first-time surface processing step of forming a first protective layer on a tool;

a coloring step of coloring a predetermined position of the first protective layer so as to form a marking area with a color layer, wherein the first protective layer is formed on a bottom surface of the marking area; and a second-time surface processing step of forming a second protective layer on a non-marking area of the tool, wherein the first protective layer is formed on a bottom surface of the second protective layer, wherein a color of the first protective layer is different from that of the second protective layer.

2. The method as claimed in claim 1, wherein the coloring step comprises a step of printing the color layer on the first protective layer.

3. The method as claimed in claim 1, wherein the coloring step comprises a step of affixing the color layer on the first protective layer.

4. The method as claimed in claim 1, wherein the second-time surface processing step is processed by an electroplating process different from that of the first-time surface processing step so that a color of the second protective layer is different from that of the first protective layer, wherein the electroplating process of each of the first-time surface processing step and the second-time surface processing step is one of copper plating, chrome plating, and nickel plating.

5. The method as claimed in claim 1, further comprising a color removing step of removing the color layer of the marking area after the first-time surface processing step, the coloring step, and the second-time surface processing step.

6. A method of marking a tool structure, comprising:

a first-time surface processing step of forming a first protective layer on a tool;

a coloring step of coloring a predetermined position of the first protective layer so as to form a marking area with a color layer, wherein the marking area has a first color area and a second color area, and a color of the first color area is different from that of the second color area, wherein a spacing area without any color layer is formed between the first color area, wherein said first protective layer is formed at a bottom surface of each of the color first area and the second color area; and a second-time surface processing step of forming a second protective layer in a non-marking area of the tool and the spacing area, wherein the first protective layer is formed on a bottom surface of the second protective layer, wherein a color of the first protective layer is different from that of the second protective layer.

7. The method as claimed in claim 6, wherein the coloring step comprises a step of printing the color layer on the first protective layer.

8. The method as claimed in claim 6, wherein the coloring step comprises a step of affixing the color layer on the first protective layer.

9. The method as claimed in claim 6, wherein the second-time surface processing step is processed by an electroplating process different from that of the first-time surface processing step so that the color of the second protective layer is different from that of the first protective layer, wherein the electroplating process of each of the first-time surface processing step and the second-time surface processing step is one of copper plating, chrome plating, and nickel plating.

10. The method as claimed in claim 6, further comprising a color removing step of removing the color layer of the first color area and the second color area of the marking area after the first-time surface processing step, the coloring step, and the second-time surface processing step.

* * * * *